US007124924B2

(12) United States Patent
Marks

(10) Patent No.: US 7,124,924 B2
(45) Date of Patent: Oct. 24, 2006

(54) DESKTOP STAPLER STRIKER/ANVIL ALIGNMENT SYSTEM

(75) Inventor: Joel S. Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 0 days.

(21) Appl. No.: 10/990,920

(22) Filed: Nov. 17, 2004

(65) Prior Publication Data

US 2006/0102688 A1 May 18, 2006

(51) Int. Cl.
*B25C 5/00* (2006.01)
*B25C 5/11* (2006.01)
*B25C 5/06* (2006.01)

(52) U.S. Cl. ..... 227/120; 227/131; 227/156

(58) Field of Classification Search ..... 227/120, 227/131, 132, 146, 156
See application file for complete search history.

(56) References Cited

U.S. PATENT DOCUMENTS

| | | | | | |
|---|---|---|---|---|---|
| 1,956,174 | A | * | 4/1934 | Maynard | 227/155 |
| 2,042,958 | A | * | 6/1936 | Pankonin | 227/122 |
| 2,142,782 | A | | 1/1939 | Gillette | |
| 2,218,794 | A | * | 10/1940 | Kilbride | 227/155 |
| 2,271,479 | A | | 1/1942 | Gambao | |
| 2,378,725 | A | * | 6/1945 | Paul | 227/155 |
| 2,421,429 | A | | 6/1947 | Obstfeld | |
| 2,657,384 | A | | 11/1953 | Boroughs | |
| 2,667,637 | A | * | 2/1954 | Marano | 227/121 |
| 2,726,391 | A | | 12/1955 | Pilblad | |
| 2,733,440 | A | | 2/1956 | Jenny | |
| 2,769,174 | A | * | 11/1956 | Libert | 227/132 |
| 2,798,219 | A | * | 7/1957 | Maynard | 227/134 |
| 2,884,636 | A | | 5/1959 | Abrams | |
| D186,342 | S | | 10/1959 | Marano | |
| 2,915,753 | A | | 12/1959 | Ruskin | |
| 3,034,128 | A | | 5/1962 | Robbins | |
| 3,630,428 | A | | 12/1971 | Olney et al. | |
| 3,758,016 | A | | 9/1973 | Olney et al. | |
| D243,148 | S | | 1/1977 | Levin | |
| 4,156,499 | A | | 5/1979 | Frank | |
| 4,206,863 | A | | 6/1980 | Savino | |
| 4,463,890 | A | | 8/1984 | Ruskin | |
| 4,546,909 | A | | 10/1985 | Ebihara | |
| 4,598,852 | A | | 7/1986 | Olesen | |
| 4,666,075 | A | | 5/1987 | Olesen | |

(Continued)

FOREIGN PATENT DOCUMENTS

| | | |
|---|---|---|
| DE | 2856-621 | 12/1978 |

(Continued)

*Primary Examiner*—Sameh H. Tawfik
*Assistant Examiner*—Nathaniel Chukwurah
(74) *Attorney, Agent, or Firm*—Paul Y. Feng; Fulwider Patton LLP

(57) ABSTRACT

A desktop stapler having a feature for alignment of the anvil with the striker is disclosed. In one embodiment, a stapler body containing a striker is pivotably attached to a base. The pivoting rotation of the body causes a front-to-back motion of the striker over an anvil. A rib disposed at the back end of the body selectively pulls the back end of a linkage to the anvil backward as the body pivots downward to the stapling position. The anvil thus translates in relation to the body to maintain a close alignment of the striker over the anvil. The base assembly may include a cover plate slidable upon a base, wherein the cover plate includes the anvil. Another embodiment uses a tab that urges a staple track to be forcibly pulled open as the body is rotated away from the base.

15 Claims, 5 Drawing Sheets

U.S. PATENT DOCUMENTS

| | | | | | |
|---|---|---|---|---|---|
| 4,795,073 | A | * | 1/1989 | Yamamoto et al. | 227/120 |
| 4,811,884 | A | | 3/1989 | Sato | |
| 5,004,142 | A | | 4/1991 | Olesen | |
| 5,165,587 | A | * | 11/1992 | Marks | 227/132 |
| 5,356,063 | A | | 10/1994 | Perez | |
| 5,699,949 | A | | 12/1997 | Marks | |
| 5,715,982 | A | | 2/1998 | Adachi | |
| 5,765,742 | A | * | 6/1998 | Marks | 227/132 |
| 5,816,470 | A | | 10/1998 | Plato et al. | |
| D413,239 | S | | 8/1999 | Lovegrove et al. | |
| 5,931,364 | A | | 8/1999 | Dennis | |
| 5,979,736 | A | | 11/1999 | Edeholt | |
| 5,988,478 | A | | 11/1999 | Marks | |
| 6,145,728 | A | | 11/2000 | Marks | |
| 6,152,347 | A | | 11/2000 | Wilson et al. | |
| D437,754 | S | | 2/2001 | Jacquet | |
| 2004/0232192 | A1 | | 11/2004 | Marks | |

FOREIGN PATENT DOCUMENTS

| | | | |
|---|---|---|---|
| DE | 19712849 | A1 | 10/1998 |
| DE | 10138447 | A1 | 7/2003 |
| DE | 10225816 | A1 | 1/2004 |
| GB | 2032327 | A | 5/1980 |
| GB | 2229129 | A | 9/1990 |

* cited by examiner

Fig. 1
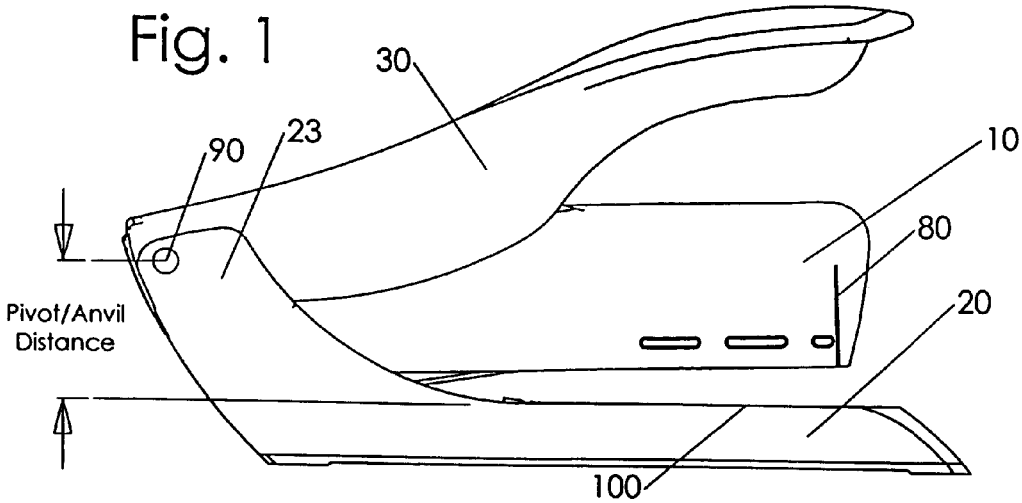
Fig. 3
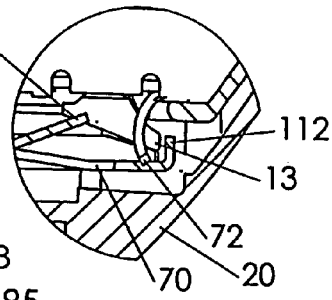
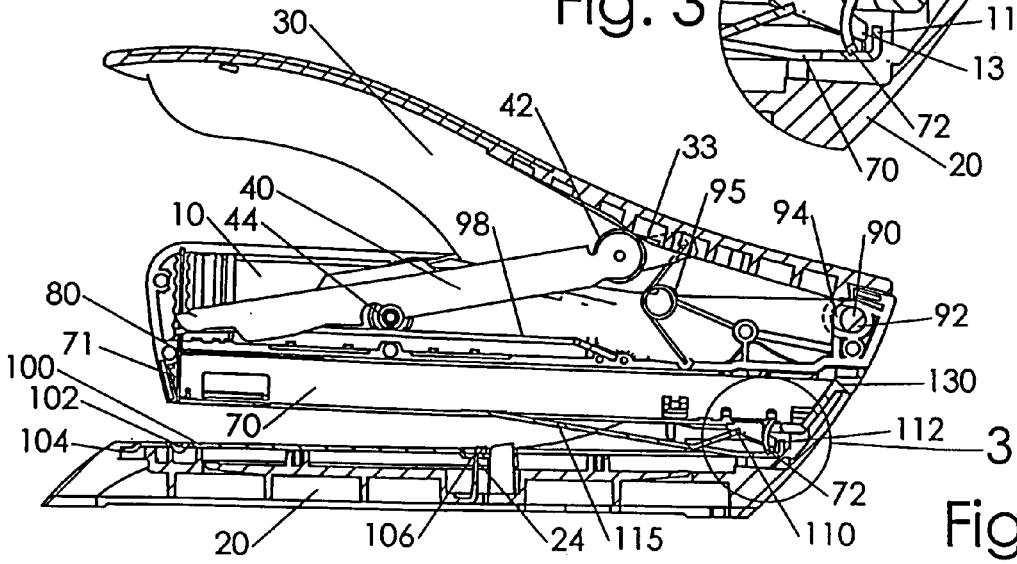
Fig. 2
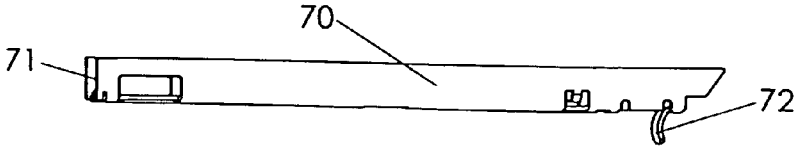
Fig. 4

DESKTOP STAPLER STRIKER/ANVIL ALIGNMENT SYSTEM

FIELD OF THE INVENTION

The present invention relates to desktop staplers. More precisely, the present invention relates to structures for positioning of a stapler anvil and opening a loading track.

BACKGROUND OF THE INVENTION

A desktop stapler normally includes a lower base portion and a main body pivotally attached to the base. The body pivots toward the base in normal use as the stapler handle is pressed to eject a staple from the staple track. A striker urges a staple out of a staple exit location toward an anvil, where the anvil is immediately under a stack of papers to be fastened together. The anvil bends the legs of the staple so that the legs clinch behind the papers. It is important that the striker remain aligned with the anvil, being neither too much in front nor too rearward of the anvil. Misalignment of the striker and anvil prevents the staple from forming correctly behind the papers since the legs bend forward or rearward where it is desired only that the legs be bent toward each other.

Such a defective curl or formation of the staple behind the stack of stapled papers renders the staple unsuitable for its intended purpose of fastening the papers together. The user must then somehow unfasten the defective staple and re-staple the stack. Uncurling, detaching or withdrawing the defective staple from the stack is time consuming and an irritation, often requiring use of a staple puller, a bladed tool to slide underneath the staple to pry it loose, or finger pinching manipulation. It is at the very least a nuisance to fix a defective staple and is undoubtedly a waste of productive time.

Typically the stapler body is pivoted from a position above the base. As the body arcs downward about the pivot into position just above the anvil to eject a staple, the staple exit location underneath the striker translates rearward in relation to the anvil.

In particular, in a conventional stapler, the translating motion of the striker is rearward as the body moves toward the base since the pivot point is above the level of the base. An analogy is to look at the hands of a clock. If the minute hand is at the 3 o'clock position, the pivot point and the pointer of the hand are horizontally at the same level, but once the hand is pointed toward the 2 or 4 o'clock positions, the horizontal distance of the pointer of the minute hand to the pivot point has shortened as compared to the 3 o'clock position. Through basic trigonometry, if the distance from the pivot point to the striker is radius R, and the angle between the horizontal position of the body and the downward stapling position of the body is $\theta$, then the horizontal distance x that the striker translates toward the pivot point is $x=R-(R)(\cos\theta)$. On the other hand, if a stapler were designed with the pivot position at or below the level of the base, then the striker translates forward as the body moves toward the base.

Another alignment consideration is the vertical distance between the striker and the anvil at the beginning of the arcuate movement of the body. If the stapler is of small capacity, such as for stapling less than 20 pages, the amount of striker rearward translation is not significant if the pivot location is not too far above the base. However, in the case of a larger capacity stapler, such as 60 pages, the highest and lowest stapling positions of the body in relation to the anvil are quite different. If the position of the pivot is relatively high above the base, the rearward translation component of the arcing motion is further increased. Consequently, it is desirable to have a mechanism in a stapler that can closely maintain the striker to anvil alignment in spite of the front to rear translating motion and regardless of the paper capacity.

SUMMARY OF THE INVENTION

In one preferred embodiment of the present invention, a stapler base and body are pivotably attached to each other. Optionally, the base and body are slidably attached to each other. When the body pivots in an arcing motion over the base, the lower part of the body translates rearward over the base as part of the arcing motion. The sliding motion between the body and base, however, compensates for this rearward translation element of the arc.

According to one embodiment of the invention, the base includes a base assembly with two elements movable with respect to each other, a base structure, and a cover plate. The body is pivotably attached to the base assembly, while the cover plate may slide along the base structure. A resilient member biases the cover plate toward a normal position on the base assembly. When a pressing-surface of the body engages the cover plate, the cover plate moves rearward upon the base. This engagement occurs at a predetermined position of the body over the base.

Alternatively, the body may be pivotable and slidable in relation to the base, and in this embodiment the base and body may be a single hinged structure.

A further embodiment of the present invention includes a tab extending down from a staple track. As the body is opened away from the base, this tab is forced to move rearward so that the track is assured to be in an unlatched position before the stapler is fully opened.

BRIEF DESCRIPTION OF THE DRAWINGS

FIG. 1 is a side elevational view of a stapler that includes elements of the present invention.

FIG. 2 is a partial cross-sectional view of the stapler of FIG. 1, showing components of a spring-actuated stapler.

FIG. 3 is a magnified, cross-ectional view of elements of the present invention at a rear of the stapler encircled and labeled 3 in FIG. 2.

FIG. 4 is a side elevational view of a stapler track.

DETAILED DESCRIPTION OF THE PREFERRED EMBODIMENTS

In the exemplary embodiment of the present invention described below, a spring actuated stapler is shown. In such a spring-actuated stapler, the striker is energized and actuated by the potential energy stored in a spring, rather than from inertia generated by a user pushing down on the actuation handle in a conventional stapler. In one version of a spring-actuated desktop stapler, pressing down on the actuation handle lifts the striker upward against the bias of a power spring. When the striker is lifted past a certain point, it is released from the handle and the power spring accelerates the striker downward into a staple which upon impact is ejected from the stapler.

In another version of a spring-actuated stapler, the striker has a rest position above the staple track rather than in front of the staple track. Pressing the actuation handle energizes a spring that is linked to the striker. The striker is released at a predetermined position of the handle and the striker moves down to eject a staple. In the reset action, the assembly of the handle, striker, and spring all move upward together to the rest position. Although the following exemplary embodiments of the present invention are described in connection with a spring-actuated stapler, it is contemplated that the present invention can also be applied to a conventional stapler.

Figure 9:
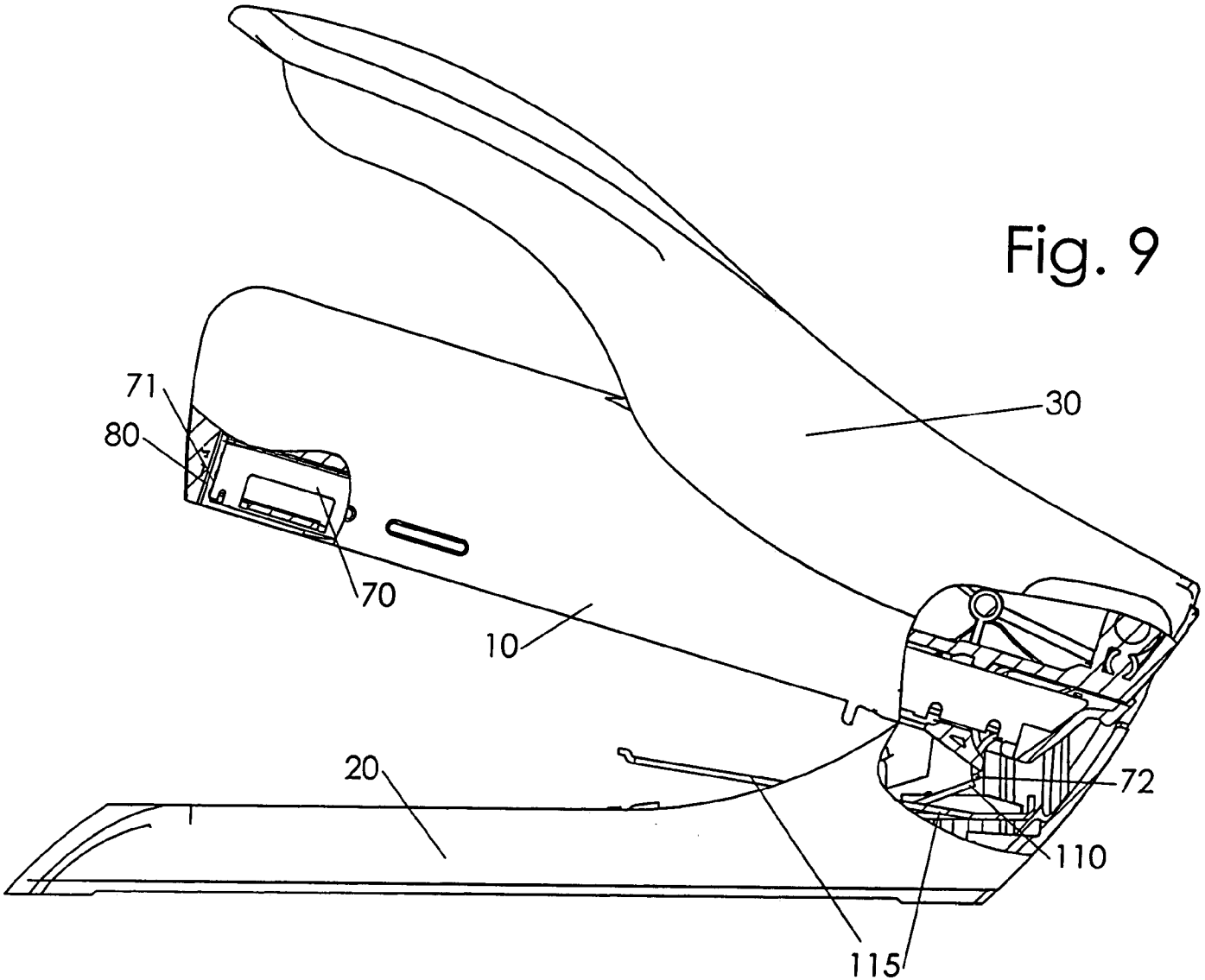
FIG. 9 is the stapler of FIG. 8 depicted in a side elevational view and showing the body pivoted slightly farther from the base.

In FIG. 1, a stapler includes pivot 90 attached to sidewalls 23 of base 20. Body 10 pivots in relation to base 20 about pivot 90. Pivot 90 is spaced above cover plate 100, FIG. 5, by the "Pivot/Anvil Distance" where cover plate 100 includes anvil 102, FIG. 2 formed into cover plate 100. It may be desired to locate this tall position for pivot 90 so that body 10 can be fully opened when it is pivoted by a half rotation to extend rearward from base 20 (not shown) with track pull 130 well exposed for access. In this configuration, track 70 can be slid out from its position within body 10 by pulling on track pull 130. Track 70 would slide to the left in FIG. 2 if body 10 were fully opened as described. FIG. 9 shows an intermediate position of this rearward rotation.

Still in FIG. 2, if pivot 90 were located below the horizontal level of the cover plate 100, then the respective directions of movements between body 10 and base 20 would be reversed.

The front bottom area of body 10 includes a lower end of striker 80. Striker 80 is preferably made from a metal and freely travels linearly along tracks or grooves inside body 10. In the "uppermost body position," shown in FIGS. 1 and 2, body 10 is at rest above base 20 providing more space than required for a maximum number of paper sheets. The extra space eases the insertion of papers upon anvil 102, underneath striker 80.

In FIG. 2, the basic components of one type of a spring-actuated stapler are shown. Body 10 contains lever 40, which pivots at an intermediate position thereof about post 44 and is biased by reset and/or power springs 95, 98. Wheel 42 or bearing surface rolls or slides upon ramp 33 within handle 30 as the handle is pressed downward by a user. A front end of lever 40 releasably engages or latches a slot opening in striker 80. With the front end of lever 40 initially linked to striker 80, the user pressing handle 30 downward rotates lever 40 about pivot 44 against the reset spring bias, which rotation lifts striker 80 upward against the power spring bias. Once reaching a predetermined rotational position with lever 40, striker 80 is suddenly de-linked from lever 40. With the opposing force supplied by lever 40 suddenly removed, power spring 98 accelerates striker 80 downward in a driving stroke. Near the bottom of the driving stroke, striker 80 impacts and ejects a staple from front end 71 of track 70 containing a bundle of staples.

With the staple ejected, the user removes pressure on the handle 30. Reset spring 95, which engages a rear distal end of lever 40, biases handle 30 upward to return it to the start position. The front end of lever 40 travels downward and again latches against the slot opening in striker 80. The stapler is now ready to fire the next staple.

Body 10 moves downward from its uppermost position as handle 30 is pressed, pivoting about pivot 90. Track pull 130 is fitted to the rear end of track 70 to releasably hold track 70 within body 10. Base 20 is part of a base assembly including cover plate 100. Cover plate 100 is held down in base 20 optionally at the front thereof by tab 104. Base spring 24 engages edge 106 of the cover plate, urging the cover plate forward against a stop such as at tab 104.

Figure 5:
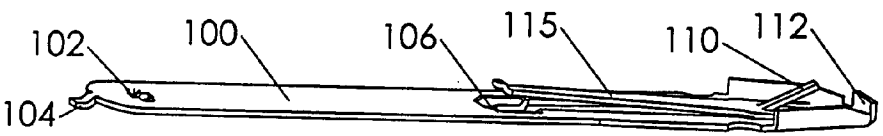
FIG. 5 is an upper side elevational view of a cover plate for a base.

Cover plate spring 115, as best seen in FIG. 5, holds body 10 in the raised position. Pressing-surface 13, FIG. 3, is preferably an element of body 10 and is spaced from rib 112 of cover plate 100 in its normal, uppermost, position shown in FIGS. 1 and 2. Therefore, pressing-surface 13 is de-linked from cover plate 100 and anvil 102 in the uppermost body position, and striker 80 is not precisely aligned vertically with anvil 102. Optionally, pressing surface 13 may engage rib 112 for all normal positions of body 10. However, cover plate 100 will then slide a greater distance upon base 20 than is required for actual stapling positions of body 10. This would require, for example, that base spring 24 flex more than necessary. Track 70 includes force-open tab 72 discussed below.

Figure 6A:
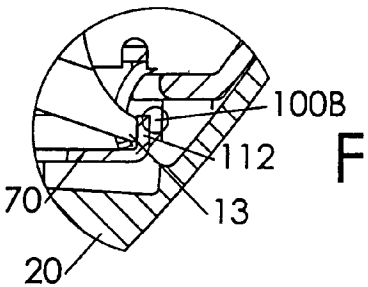
FIG. 6A is a magnified, cross-sectional view of a rear portion of the stapler with a pressing-surface of the body contacting the cover plate, encircled and labeled as 6A in FIG. 6.
Figure 6:
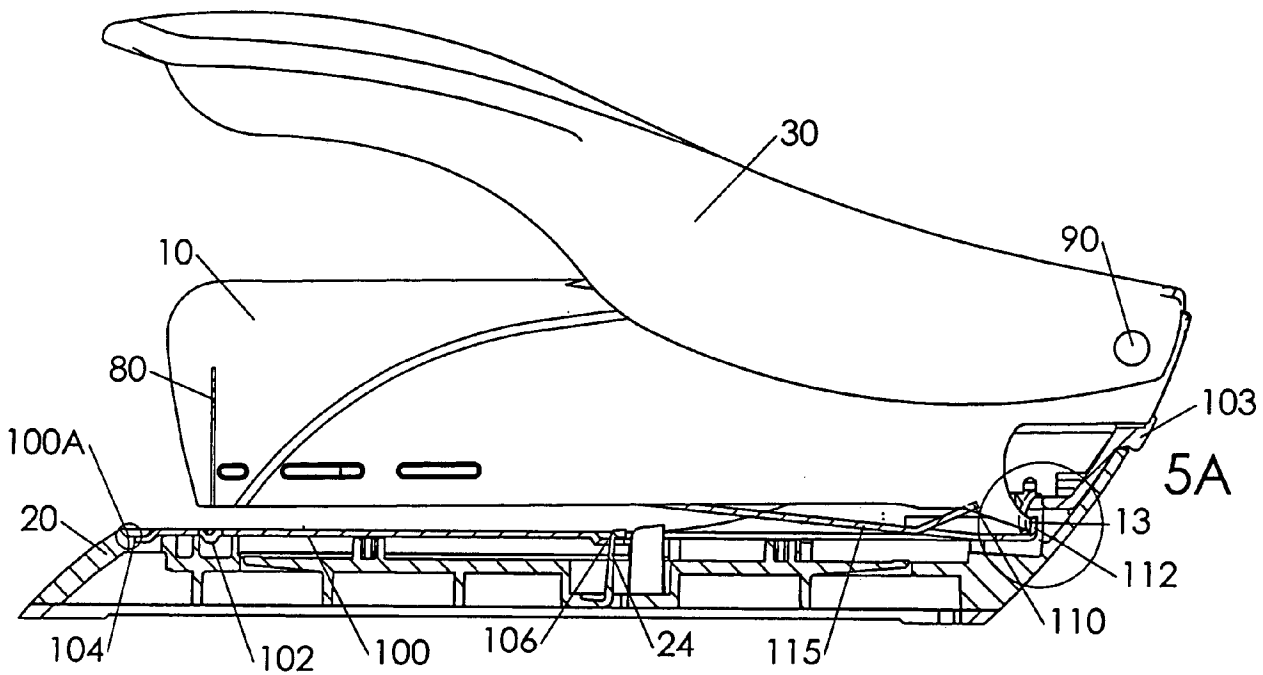
FIG. 6 is a side elevational view, partly in cross-section, of the stapler of FIG. 2 with the body pivoted partially toward the base.

More precisely depicted in FIGS. 6 and 6A, body 10 is pivoted to a "high body position" toward base 20. The high body position is below the uppermost body position depicted in FIGS. 1 and 2. The vertical space between striker 80 and anvil 102 is about equal to a thickness of the maximum rated stack of papers intended for the stapler. For example, the stapler shown in the drawing figures may have a 60 page capacity, then the space above anvil 102 would fit about 60 pages. The space above the anvil is preferably about 0.5 –0.8 inch in the uppermost body position, and about 0.1 –0.4 inch in the high body position. Of course, for industrial or heavy duty commercial applications, the space above the anvil may be greatly enlarged to accommodate larger stacks of papers that may be made from thicker material.

In the high body position of FIGS. 6 and 6A, pressing-surface 13 just contacts rib 112, but cover plate 100 has not yet moved rearward. Nevertheless, pressing-surface 13 and anvil 102 are now linked via cover plate 100. The position of cover plate 100 is referenced at front reference number 100A and rear reference number 100B in FIGS. 6 and 6A, respectively.

Figure 7A:
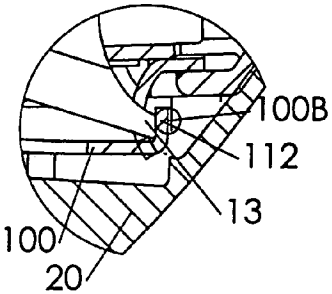
FIG. 7A is a magnified, cross-sectional view of an encircled area in FIG. 7, with the pressing-surface urging the cover plate rearward.
Figure 7:
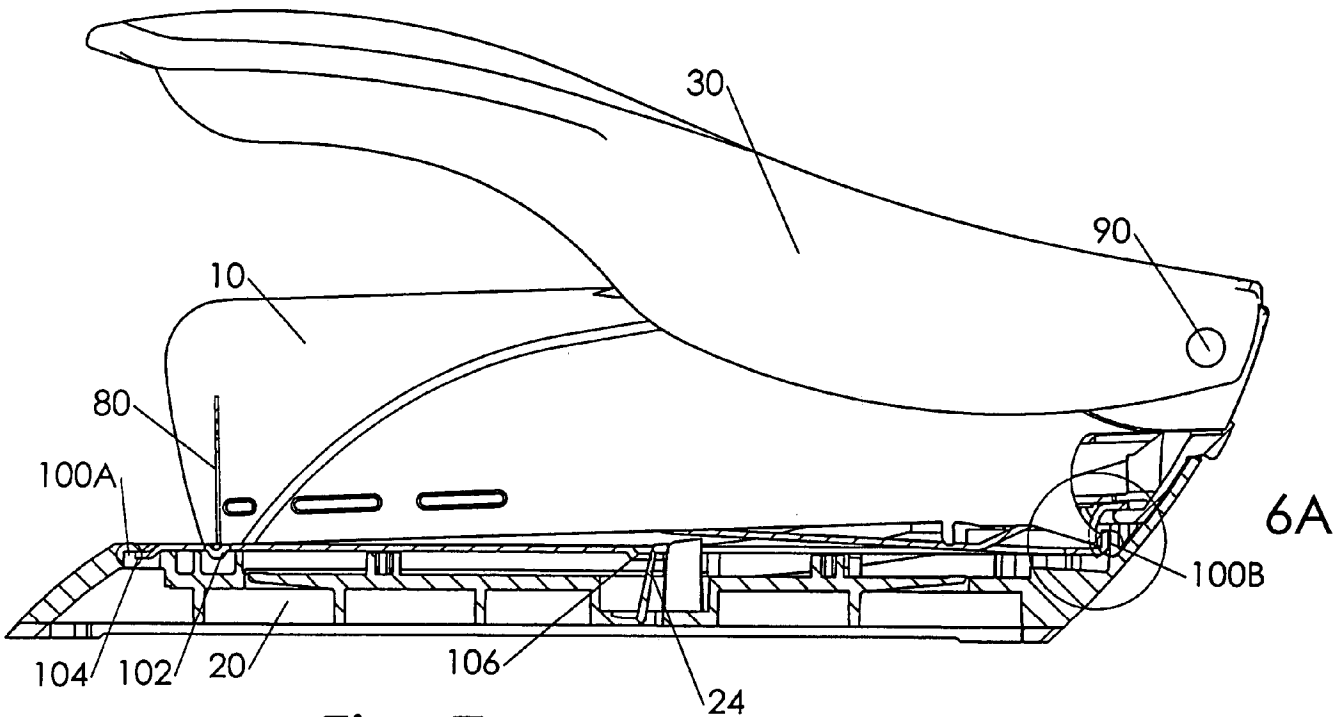
FIG. 7 is a side elevational view, partly in cross-section, of the stapler of FIG. 6, with the body pivoted downward to its limit against the anvil.

In FIG. 7, body 10 is pivoted downward to its limit at a "lowest body position" wherein striker 80 is in contact with cover plate 100 and/or anvil 102. This is, for example, approximately the position that corresponds to stapling the minimum of two sheets of paper. A larger stack of paper would cause the lowest position to be increased accordingly. At reference numbers 100A and 100B, it can be seen that cover plate 100 has moved rearward from that shown in FIG. 6. The gap at 100A in front of tab 104 has increased while rib 112 has moved to rearward in FIG. 7A. The different cover plate positions, due to its horizontal translation, are thus apparent in comparing FIGS. 6 and 7. To enable this fore-aft translation of cover plate 100 relative to base 20, the lengthwise dimension of the opening receiving cover plate 100 therein is slightly greater than the length of cover plate 100. Alternatively, the opening can be omitted so that the cover plate is slidably attached to a top surface of the cover plate and.

One purpose of this fore-aft translation of cover plate 100 is to maintain the alignment of anvil 102 underneath striker 80 which when contained inside body 10 travels in an arc around pivot 90. In FIG. 2, striker 80 is aligned vertically in front of anvil 102. That is not important at this moment, however, since the stapling operation does not occur in this highest body position. Indeed, the highest body position advantageously serves to facilitate inserting a stack of papers to be stapled.

In FIG. 6 the stapler body is in the highest position in which stapling actually will occur, using the largest expected stack of papers. At this position, striker 80 is precisely or much more precisely than in conventional staplers, aligned over anvil 102, i.e., in the fore/aft direction. As body 10 pivots farther toward base 20, the bottom of striker 80 moves rearward along base 20. This is a result of the high position of pivot 90 and the arcing motion that results therefrom. Beginning at the downward progressing position shown in FIG. 6, pressing-surface 13 makes contact with rib 112 of cover plate 100 and begins to urge cover plate 100 with anvil 102 rearward.

Pressing-surface 13 is near the same vertical position as the bottom of striker 80 and anvil 102. Therefore, rib 112 preferably moves rearward the same distance as the bottom of striker 80. As seen in FIG. 7, the bottom of striker 80 remains fairly precisely aligned with anvil 102.

As seen in FIGS. 3 and 5, pressing-surface 13 preferably has a blade shape and extends downward and rearward from body 10, while rib 112 bends upward from cover plate 100 in the manner of a slight hook. The leading edge of the blade shape of pressing-surface 13 slidably engages the hooked surface of rib 112 as seen in FIG. 6A.

Other means of selectively linking the movement of the body containing the striker to actuate fore/aft translation of the anvil located in the base are contemplated. For example, the pressing-surface can be one or more bumps, claws, half-crescents, raised contours, or the like that grasp, engage, or otherwise latch onto the rib, slot, groove, stop, bump, ramp, or like structure to cause the rearward translation of anvil 102 via cover plate 100 as body 10 moves toward base 20. The locations of the pressing-surface and the rib can be situated anywhere near the back end of the stapler insofar as the rotational movement of body 10 relative to pivot 90 can be efficiently transferred to the translational movement of the anvil through the cover plate or other linkage.

Optional base spring 24 presses edge 106 of cover plate 100 to bias the plate forward. In FIG. 7 it is seen that base spring 24 is deflected rearward from its position of FIG. 6 since cover plate 100 has been moved rearward. Cover plate spring 115 biases body 10 upward. Therefore, as a user releases the stapler, body 10 moves upward and base spring 24 returns to its normal shape of FIG. 6 and translates the cover plate 100 forward. Cover plate 100 then returns to its rest position shown in FIG. 2, 3, or 6. In the illustrated embodiment, base spring 24 is a cantilevered element of molded base 20. Other types of base springs may be used and their location can be changed to suit design needs.

According to an alternative embodiment (not shown), the base assembly includes a slidable anvil linked to the pressing-surface by a bar or other structure that engages the anvil and pressing-surface. For example, the anvil can be formed into a small plate slidably disposed in an opening near the front end of the base. A flat bar or small wire extending along the major length of the base curls or bends upward at the back end to link with the pressing-surface. The flat bar, wire, or the like then serves as the linkage to translate the small plate containing the anvil rearward, and the need for a cover plate has been eliminated.

In one alternative embodiment, the base of the stapler is a single element without a slidable cover plate or anvil. However, alignment according to the present invention may still be accomplished. Specifically, shown in FIG. 2, pin 92 extends laterally from body 10 would engage optional elongated slot 94 in either of sidewalls 23 so that body 10 is capable of translating along front and rear pivot positions at the dimensional extremes of elongated slot 94.

Then pressing-surface 13 pivots upon what is now an immovable or immobile rib 112, or an equivalent structure, while body 10 translates slightly forward between the respective pivot positions of elongated slot 94 in relation to sidewalls 23. The bottom of striker 80 arcs nearly vertically at anvil 102 since the pivot point at immobile rib 112 is near the same vertical position as anvil 102. In this alternative embodiment, body 10 is in a rear position at pivot 90 with respect to sidewalls 23 in the uppermost and high positions of FIGS. 1 to 6. In the lowest position of FIG. 7, body 10 is translated slightly forward at pivot 90 with respect to sidewalls 23. Accordingly, with either a movable cover plate embodiment or a fixed cover plate embodiment, the striker and anvil remain aligned for the various quantities of papers to be stapled.

Figure 8:
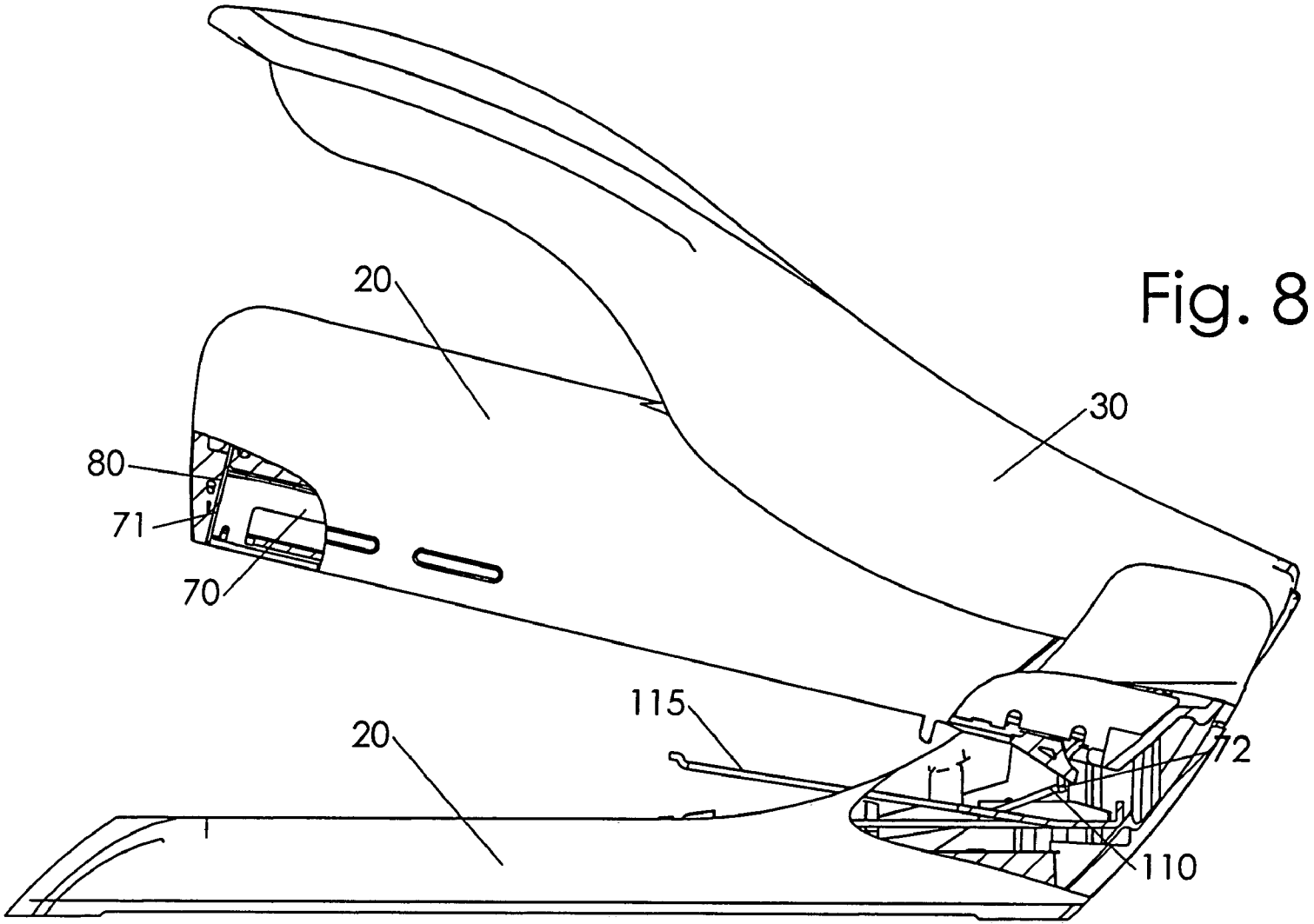
FIG. 8 is a side elevational view of a stapler, with cut-away sections, with the body pivoted partly away from the base.

In FIGS. 8 and 9, a structure is shown that forces track 70 to open slightly as body 10 is pivoted upward from base 20. If a staple becomes jammed at front end 71 of track 70, striker 80 may stay in the raised position and power spring 98 stays energized. If a user fully opens the stapler so that the bottom of body 10 faces upward, the striker may suddenly release if the user forcefully pulls the track open by tugging on track pull 130. It is desirable to pull the track open slightly before the stapler is fully opened.

In FIG. 8, body 10 is pivoted to a first open position away from base 20. Track tab 72 extends downward toward cover plate 100, also seen in FIG. 4, and contacts spring tab 110. Spring tab 110 is an element of base 20 or the base assembly including cover plate 100 and base 20. In FIG. 9, body 10 is pivoted to a second open position farther from base 20. As body 10 is raised to the second open position of FIG. 9, the contact between track tab 72 and spring tab 110 continues. It is seen that this is a sliding contact wherein track tab 72 has moved upward along spring tab 110 as body 10 rises between the position of FIGS. 8 and 9. At the same time, track tab 72 is biased forward as body 10 arcs about pivot 90. However, track tab 72 cannot move forward since spring tab 110 is not substantially movable. Thus, track tab 72 and track 70 are forced to slide rearward, to the right in FIGS. 8 and 9, in relation to body 10 after track pull 130 has been unlatched from body 10 through a further mechanism (not shown).

In FIG. 8, track front end 71 is immediately adjacent to striker 80 in a track operating position. Spring tab 110 and track tab 72 have just made contact in this track operating position. In FIG. 9, track front end 71 is spaced to the rear of striker 80 in a rearward unlatched track position as the spring tab and track tab continue to engage. Upon further rotation of body 10 upward (not shown) past the second body open position, track tab 72 rises upward out of engagement with spring tab 110 so track 70 is not forced to slide farther rearward through this mechanism.

In the preferred embodiment, body 10 is formed from a polymer shell as is base 20. Since the preferred embodiment stapler operates under spring power rather than by inertial impact applied in conventional, direct handle-to-striker staplers, these components do not require the strength of metal and can be made from lightweight polymers. Material costs based on polymers as opposed to metals are reduced. Use of polymers reduces weight, bulk, and eliminates possibility of rusting.

Accordingly, the polymer shell of base 20 may be made from glass filled polypropylene, polycarbonate, or the like. The polymer shell may optionally be formed in halves and made from high strength, low friction nylon. Of course, other materials may be used such as die cast metal. Die cast metal may be desirable if higher weight is needed. Anvil 102 is preferably formed into cover plate 100. Cover plate 50 may be made from steel, plastic, or other non-ferrous material.

From the foregoing detailed description, it should be evident that there are a number of changes, adaptations and modifications of the present invention that come within the province of those skilled in the art. However, it is intended that all such variations not departing from the spirit of the invention be considered as within the scope thereof except as limited solely by the following claims.

I claim:

1. A desktop stapler, comprising:

an elongated base assembly;

a body pivotably attached to the base at a pivot location toward a rear end of the stapler, the base and the body extending forward from the pivotal attachment in a spaced relationship between the base and the body;

an anvil slidably disposed on the base toward a front end of the stapler;

a striker slidable within the body above the anvil;

wherein the body includes a high position where the striker is spaced away from the anvil, and a low position where the striker is spaced near to the anvil;

the pivot location is above the anvil by a pivot/anvil distance;

the anvil translates between a forward rest position and a rearward position; and a pressing-surface of the body is linked to the anvil, and the pressing-surface of the body moves between a first position toward a second position as the body is pivoted from the high position toward the low position, wherein the anvil is translated from the forward rest position toward the rearward position through the link between the anvil and the pressing-surface.

2. The desktop stapler of claim 1, wherein the anvil is substantially aligned with the striker in a front/back direction in each of the high and low positions of the body.

3. The desktop stapler of claim 1, wherein the base includes a cover plate wherein the anvil is formed into the cover plate, and the pressing-surface engages a rib of the cover plate.

4. The desktop stapler of claim 3, wherein a spring extends between the base and the cover plate, and the spring biases the cover plate in a forward direction on the base.

5. The desktop stapler of claim 4, wherein the spring is cantilevered from the base and extends from the base to engage an edge of the cover plate.

6. The desktop stapler of claim 1, wherein the body includes an uppermost position, and the pressing-surface is de-linked from the anvil in the uppermost body position.

7. The desktop stapler of claim 6, wherein the striker and anvil are not aligned in a front/back direction in the uppermost body position.

8. A desktop stapler, comprising:

a handle and body hinged to a base at a back end of the stapler;

a striker disposed to move vertically within the body at a front end thereof;

an anvil disposed to slide forward and rearward in the base and positioned generally underneath the striker, wherein the anvil is formed into a cover plate that is slidably disposed in an opening in the base; and means for selectively linking a back end of the body to the anvil;

wherein the means for selectively linking urges the anvil to slide rearward as the body pivots toward the base thus maintaining vertical alignment of the anvil with the striker.

9. The desktop stapler of claim 8, wherein the means for selectively linking includes a rib linked to the anvil and extending upward from a back end of the base, and a pressing-surface extending downward and rearward from a back end of the body wherein the pressing-surface urges the rib rearward to cause the rib to move rearward as the body pivots toward the base.

10. The desktop stapler of claim 8, wherein the opening in the base is slightly longer than the length of the cover plate to enable linear translation of the cover plate relative to the base.

11. The desktop stapler of claim 8, further comprising a power spring biasing the striker to drive the striker downward; a lever pivoting at an intermediate location thereof and disposed within the body, pivoted by the handle to selectively link to the striker at a front end thereof to lift the striker against the bias of the power spring.

12. The desktop stapler of claim 8, wherein the anvil is affixed and immobilized on the base, and the hinge between the body and base includes at least one post extending from the body and pivotably and slidably engaging a complementary elongated slot in the base, wherein the sliding action of the post enables the body to translate forward or rearward relative to the base.

13. The desktop stapler of claim 8, wherein the body and the base include shells formed from a polymeric material.

14. The desktop stapler of claim 8, further comprising a spring biasing the cover plate against the urging of the pressing-surface.

15. The desktop stapler of claim 8, wherein a space between the striker and the anvil is about 0.5–0.8 inch in an uppermost body position of the body.

* * * * *